US009556619B2

(12) United States Patent
Hunsaker et al.

(10) Patent No.: US 9,556,619 B2
(45) Date of Patent: Jan. 31, 2017

(54) FIBER ENFORCED THIN BRICK SHEET AND PROCESS

(75) Inventors: Jason Hunsaker, Woodland Hills, UT (US); Jeffrey Walker, South Weber, UT (US); Garrick Hunsaker, Herriman, UT (US)

(73) Assignee: Old Mill Brick Incorporated, Bluffdale, UT (US)

( * ) Notice: Subject to any disclaimer, the term of this patent is extended or adjusted under 35 U.S.C. 154(b) by 0 days.

(21) Appl. No.: 13/278,815

(22) Filed: Oct. 21, 2011

(65) Prior Publication Data

US 2013/0097950 A1 Apr. 25, 2013

(51) Int. Cl.

| | |
|---|---|
| ***E04F 13/073*** | (2006.01) |
| ***E04F 13/08*** | (2006.01) |
| ***E04F 13/14*** | (2006.01) |
| ***E04F 15/16*** | (2006.01) |
| ***E04F 15/08*** | (2006.01) |

(52) U.S. Cl.

CPC ..... *E04F 13/0733* (2013.01); *E04F 13/0862* (2013.01); *E04F 13/0885* (2013.01); *E04F 13/142* (2013.01); *E04F 15/08* (2013.01); *E04F 15/166* (2013.01); *Y10T 156/1092* (2015.01)

(58) Field of Classification Search

CPC ..... E04F 13/0733; E04F 13/0862; E04F 13/0885; E04F 13/0887; E04F 13/147; E04F 15/08; E04F 13/185

USPC ..... 52/311.2, 314, 315, 388, 555, 344

See application file for complete search history.

(56) References Cited

U.S. PATENT DOCUMENTS

| | | | | |
|---|---|---|---|---|
| 1,853,824 A * | 4/1932 | Krauss | E04F 13/147 428/47 |
| 1,926,257 A | 9/1933 | Bawtenheimer | |
| 2,198,466 A | 4/1940 | Stolze | |
| 2,208,094 A | 7/1940 | Crandall | |
| 2,392,232 A | 1/1946 | Crafton | |
| 2,419,047 A | 4/1947 | Young | |
| 2,887,867 A * | 5/1959 | Burchenal | B32B 37/00 156/299 |
| 3,067,545 A * | 12/1962 | Gaines | E04F 13/147 52/314 |
| 3,304,673 A | 2/1967 | Ramoneda | |
| 3,426,490 A * | 2/1969 | Taylor | 52/204.1 |

(Continued)

FOREIGN PATENT DOCUMENTS

JP 2005-320683 A 11/2005

OTHER PUBLICATIONS

International Search Report and Written Opinion of the International Searching Authority dated Jun. 10, 2010, that issued in International Application No. PCT/US2009/063430 (which claims priority to U.S. Appl. No. 12/266,416, filed Nov. 6, 2008).

(Continued)

*Primary Examiner* — Brian Glessner
*Assistant Examiner* — Adam Barlow
(74) *Attorney, Agent, or Firm* — Stoel Rives LLP

(57) ABSTRACT

A fiber enforced sheet for use as a wall or floor covering which comprises of adhered thin bricks bonded to a fiber-reinforced, backing layer. Thin brick is adhered to the fiber enforced sheet. The fiber enforced backing increases strength and rigidity to the thin brick during handling, and installation permits the thin bricks to be adhered to proper specification and spacing to be cut using ordinary tile or thin brick tools.

17 Claims, 4 Drawing Sheets

(56) References Cited

U.S. PATENT DOCUMENTS

| | | | | | |
|---|---|---|---|---|---|
| 3,499,256 | A | | 3/1970 | Schaaf et al. | |
| 3,521,418 | A | * | 7/1970 | Bartoloni | 52/318 |
| 3,740,910 | A | | 6/1973 | Taylor et al. | |
| 3,740,911 | A | * | 6/1973 | O'Leary | E04F 13/0862 52/388 |
| 3,908,326 | A | | 9/1975 | Francis | |
| 4,011,702 | A | | 3/1977 | Maytas | |
| 4,241,554 | A | | 12/1980 | Infantino | |
| 4,299,069 | A | | 11/1981 | Neumann | |
| 4,407,104 | A | | 10/1983 | Francis | |
| 4,589,241 | A | | 5/1986 | Volpenhein | |
| 4,642,960 | A | * | 2/1987 | Wallover, III | E04B 2/8605 52/385 |
| 4,644,719 | A | * | 2/1987 | Salazar | 52/384 |
| 4,662,140 | A | | 5/1987 | Porter et al. | |
| 4,809,470 | A | | 3/1989 | Bauer et al. | |
| 4,841,705 | A | | 6/1989 | Fuher | |
| 4,920,716 | A | * | 5/1990 | Coffey | 52/386 |
| 4,956,949 | A | | 9/1990 | Francis | |
| 5,228,937 | A | | 7/1993 | Passeno | |
| 5,311,714 | A | | 5/1994 | Passeno | |
| 5,373,676 | A | | 12/1994 | Francis et al. | |
| 5,501,049 | A | | 3/1996 | Francis et al. | |
| 5,526,630 | A | | 6/1996 | Francis et al. | |
| 5,816,005 | A | * | 10/1998 | Han | A47K 3/008 52/389 |
| 6,164,037 | A | | 12/2000 | Passeno | |
| 6,516,578 | B1 | | 2/2003 | Hunsaker | |
| 7,121,051 | B2 | | 10/2006 | Hunsaker | |
| 2003/0213212 | A1 | | 11/2003 | Passeno | |
| 2009/0255202 | A1 | * | 10/2009 | Heidemann | E04F 15/02 52/388 |
| 2010/0107531 | A1 | * | 5/2010 | Hunsaker | E04F 13/147 52/314 |

OTHER PUBLICATIONS

International Preliminary Report on Patentability dated May 10, 2011 that issued in International Application No. PCT/US2009/063430 (which claims priority to U.S. Appl. No. 12/266,416, filed Nov. 6, 2008).

*Western Thin Brick and Tile*, Brochure, (3711 East Superior, Phoenix, AZ) (printed before Feb. 12, 2001).

*Harristone*, Brochure, (G.S. Harris Co., Inc., 2795 Pennsylvania Ave., Ogden, UT) (printed Dec. 1999).

*US Brick Systems*, Installation Guide and Details (Real Brick Products, Inc., P.O. Box 200, Perry, MI 48872) (printed Jul. 1999).

*US Brick Systems*, Brochure (3700 Buffalo Speedway, Houston, TX) (printed before Feb. 12, 2001).

*Cultured Stone Product Selection Guide*, Brochure (1999, Cultured Stone Corporation, Box 270, Napa, CA (printed 1999).

*US Brick Systems*, Brochure, Sweet's Catalogue, 1995, vol. 2. (Sweet's Reference No. 04245/USB, BuyLine 2736).

* cited by examiner

FIBER ENFORCED THIN BRICK SHEET AND PROCESS

BACKGROUND OF THE INVENTION

1. Field of the Invention

This invention relates to fabricated thin brick sheets for use as wall or floor coverings and a process for manufacturing such sheets. The invention is a veneer, one layer of which comprises of an array of glued or adhesive applied thin bricks.

2. The Prior Art

Thin brick has long been a highly desired backing material for walls and floors, for interior and exterior, and the like. It is attractive, durable, waterproof, and fireproof. Thin bricks are available in a wide variety of sizes, shapes, colors, patterns, textures, and surface finishes. They are uniquely suited to a variety of applications ranging from decorative accents in the homes to complete commercial exterior finishes.

Thin brick per se is relatively inexpensive, being made essentially from clay minerals fired at high temperature. Not so its installation. The conventional construction of a thin brick wall, for example, begins with the installation of metal lath over a vapor barrier secured sheathing. Next, a scratch coat of mortar is applied to the lath followed by an accurately leveled mortar bed for the thin brick. Should the scratch coat be uneven, a separate, additional leveling layer of mortar may be required. When using adhesive brick are set one by one then grouted using mortar applied between thin brick. Individual thin bricks must be cut using special equipment and tools to fit them to spaces requiring less than a full thin brick or to fit them around fixtures and the like.

Thin brick setting is a skilled occupation, commanding high wages. The level of skill required, and the time-consuming nature of conventional thin brick installation render the process very expensive. Unfortunately, due to the high cost of thin brick installation, some builders have attempted installation shortcuts in a misguided effort to save money. Improper installation techniques frequently result in expensive repairs for the homeowner or general contractor.

Given this situation, it is not surprising to find a number of proposed solutions to the problem in the prior art. The concept of a prefabricated thin brick sheet which would not require any thin brick setting at the installation site has long been considered. However, the thin brick sheets previously described have all proved unsatisfactory for reasons such as insufficient strength, excessive weight, complexity of installation, and high labor cost. And none have met with commercial success to any significant extent.

Thus, it will be appreciated that the prefabricated thin brick sheets known in the art prior to this disclosure all relied on a core part, commonly of steel, plastic, foam, or a relatively thick backing layer to impart some measure of structural strength and rigidity to the sheets. These cores substantially increase the thickness of the sheets, and this in turn necessitates special mounting hardware for installation.

SUMMARY OF THE INVENTION

The present invention comprises a thin, lightweight thin brick sheet which greatly simplifies and reduces the cost of installing thin brick walls, floors, and the like. The invention further comprises a method of making such a sheet and or installation.

The thin brick sheets of the invention include a plurality of thin bricks pre-assembled and mounted on a fiber enforced sheet. The spaces between the thin bricks are filled with grout to seal these spaces against moisture, etc. The term "grout" should be understood to include both the conventional thin, cementitious mortar used for filling joints in masonry as well as chemicals that solidify, such as polyurethanes, room temperature vulcanizing silicones, other elastomers, plastics, and the like. The sheets normally feature a regular pattern of substantially rectangular thin bricks in a side-by-side, laterally spaced rectangular array; however, a wide variety of thin brick shapes and trim pieces are contemplated.

The thin bricks of the invention are preferably thinner and lighter than common bricks. Thus, the thin bricks will generally be greater than 0.125 inch thick, and less then 3 inches. The light weight of the thin bricks makes it possible for relatively large sheets of such thin bricks to be assembled and handled with comparative ease. The fiber enforced sheet may be made of a variety of materials. The sheets themselves will normally be flexible, but it is important that they be substantially non-stretchable. This quality is important because the backing and backing sheets on each thin brick sheet co-act to render the sheet rigid enough to be readily handled and worked.

Working of the thin brick sheets for example, may include cutting or drilling with tools such as razor knifes, table saws, and the like. After the thin bricks are adhered the sheets can then be cut between bricks using just a razor knife. This enables such working to be carried out with very little breaking, chipping, or other damage to the thin brick elements.

Applying thin brick sheets over exterior require cementitious adhesive sealing all seams and applying a roll on water barrier following all building codes. When applying thin brick sheets over interior, a thinset, mastic or equivalent will be required.

It will be apparent that the sheets be strong, substantially non-stretchable, substantially water-resistant, chemically stable, and capable of being bonded to the thin bricks as well as to plaster, wood, cement, block, drywall sheets [gypsum board; sheetrock], etc. with conventional construction adhesives. As mentioned above, woven fiberglass fabric is an especially preferred component of the backing sheets; however, other fabrics or reinforcing agents considered suitable include polyester, graphite, aramid, or carbon fibers, or any combination thereof. Especially preferred is a fiberglass combination.

Synthetic adhesives suitable for impregnating the backing sheets include unsaturated fiberglass, phenolic, epoxy, and silicone adhesives.

In general, the adhesives should possess the same general characteristics as the backing sheets. The cured adhesive should be strong, substantially non-stretchable, substantially impervious to moisture, function as an adhesive to bond the back surfaces of the thin bricks to the sheet, and be capable of being bonded to common wall surfaces and the like with conventional construction adhesives such as thin set or mastic and the like.

DETAILED DESCRIPTION OF THE DRAWINGS

Figure 1:
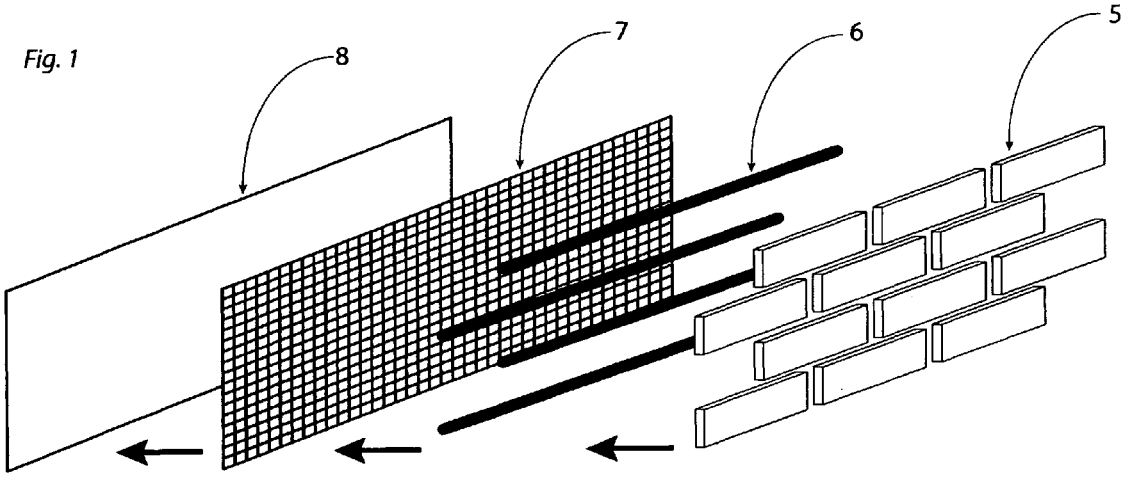
FIG. 1 Is a cross-sectional view of fiber enforced thin brick sheets of the said invention.

The invention will best be understood by referring to the drawings.

FIG. 1 shows a portion of a thin brick sheet in cross section. Individual thin brick elements (5) are supported by adhesive (6) on a fiber-reinforced backing layer (7). Anti-adhesive paper is used on back of thin brick sheets for separation and adhesive release (8).

Figure 2:
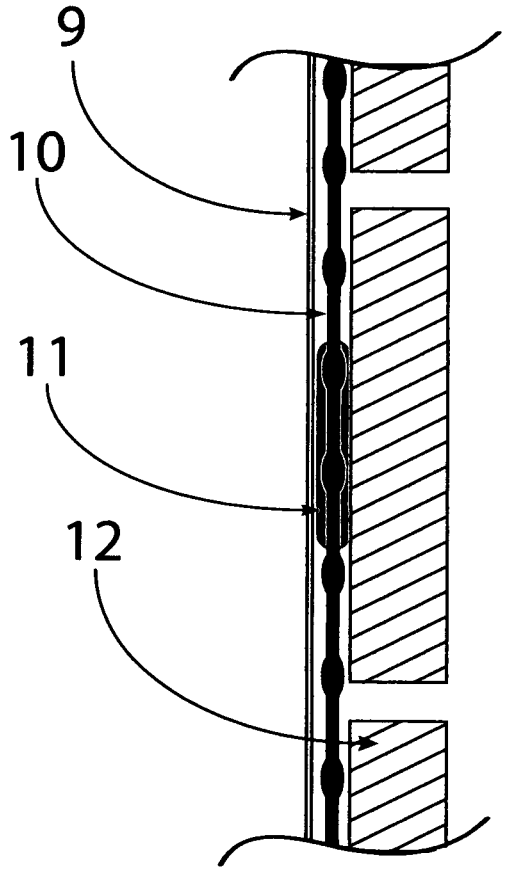
FIG. 2 Cut thru order of fiber enforced thin brick process.

FIG. 2 schematically illustrates a cut thru fabricated thin brick sheets. Thin layer of anti-adhesive paper to prevent bonding of the backing layer adhesive (9). Reinforcing fabric (10) for the backing layer. Adhesive at a high temperature is then impregnated or applied to either brick or fiber-reinforced backing layer (11). Individual thin brick elements (12).

Figure 3:
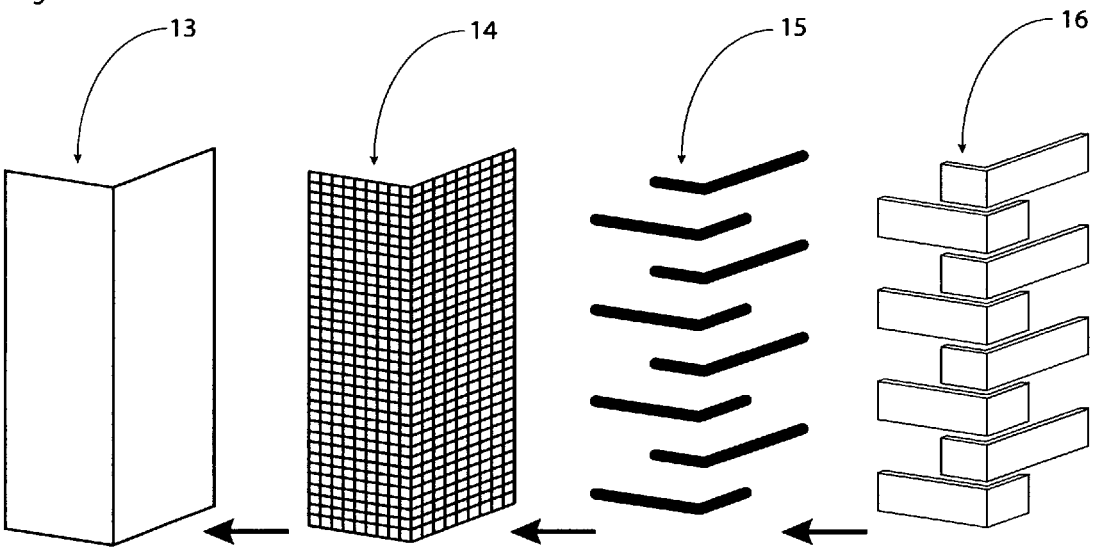
FIG. 3 Is a cross-sectional view of corner thin brick using fiber enforced thin brick sheets in the process of the said invention.

FIG. 3 schematically illustrates corner thin brick sheets. A thin layer of anti-adhesive paper is used to prevent bonding of the backing layer adhesive that is curved in the same position as a typical thin brick corner (13). A reinforced fabric sheet is shown that is curved in the same position as a typical thin brick corner (14). An adhesive at a high temperature is impregnated or applied to either a corner brick or fiber-reinforced backing layer (15). The thin corner brick positioner (16) helps in the proper spacing and alignment process.

Figure 4:
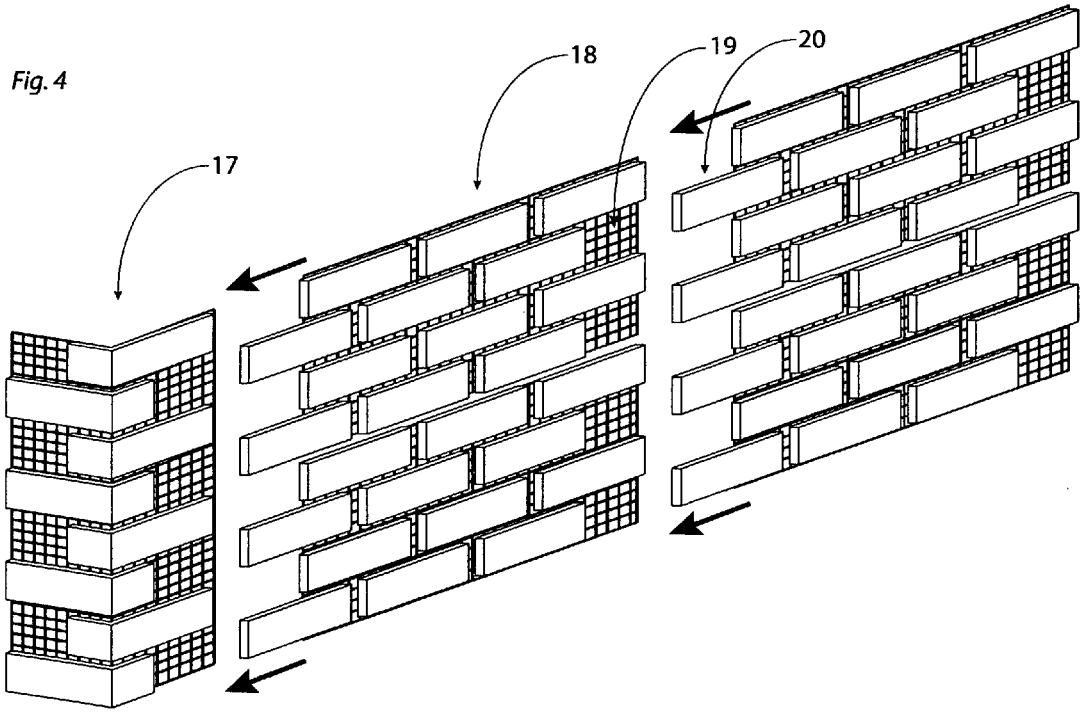
FIG. 4 View of an example layout of the corner thin brick sheets of said invention showing application arrangement and edges of such a sheet.

FIG. 4 shows in detail the layout of an optional embodiment of the thin brick sheets and corner sheets of the present invention. Corner sheets are typically applied first (17) where bricks are placed opposite of each other. The thin bricks are staggered in typical brick patterns (18) and fiber-reinforced backing layer extends beyond the thin brick elements on one edge of the sheet (19), while on the opposite edge the thin brick elements overhang the fiber-reinforced backing layer by an equal distance (20). This permits abutting thin brick sheets to be joined together in such a way that the joint between bricks are the proper space to adjacent thin brick sheets.

Additional embodiments are also disclosed. In some embodiments, the fiber enforced thin brick sheet is semi-flexible, substantially non-stretchable, and comprises glass filaments. The fiber enforced thin brick sheet further comprises a thin brick layer comprising a plurality of thin bricks bonded on their back surfaces to a backing layer.

In some embodiments, the fiber enforced thin brick sheet comprises thin bricks. The thin bricks can comprise multiple types of brick, including clay, cast brick, wire cut, and the like. The thin bricks can be formed or cut to be thin bricks. The thin bricks are applied to a backing layer. The backing layer is a fiber-reinforced sheet.

In some embodiments, the fiber enforced thin brick sheet comprises thin bricks. The way in which you lay individual thin bricks can vary in multiple ways, and show a variety of patterns or bonds. Different combinations of brick bond examples include running bond, stack bond, English bond, and the like.

In some embodiments, the backing layer is a fiber-reinforced sheet.

In some embodiments, the adhesive is selected from the group consisting of bonding adhesive, epoxy adhesive, and silicone adhesive.

In some embodiments, the reinforcing fiber is selected from one or more members of the group consisting of graphite fibers, aramid fibers, carbon fibers, and fiberglass fibers. In some embodiments, the fibers are woven into a grid like fabric.

In some embodiments, the backing layer is poly fiber. In some embodiments, the backing layer is formed of spun bonded glass filaments.

In some embodiments, the fiber enforced thin brick sheets overhang on one edge while on the opposing end the thin brick overhangs the backing layer as to interlock an adjoining sheet.

In some embodiments, an adhesive of the backing layer bonds the thin bricks of the thin brick layer to the backing layer.

In some embodiments, the thin bricks are spaced from one another and the spaces between adjacent thin bricks in the thin brick layer are filled with mortar or grout. In some embodiments, the spaces between adjacent thin bricks in the thin brick layer are filled with a cement base material.

In some embodiments, the adhesive is a silicone based product.

In some embodiments, a process for producing a fiber enforced thin brick sheet comprises adhering individual thin bricks into a rectangular array, leaving spaces of approximately ¼ inch to ¾ inch between adjacent thin bricks.

In some embodiments, a process for producing a fiber enforced thin brick sheet comprises a reinforcing fabric made of fibers selected from the group consisting of fiberglass fibers, graphite fibers, aramid fibers, carbon fibers, and poly fibers.

In some embodiments, a process for producing a fiber enforced thin brick sheet comprises an adhesive selected from the group consisting of unsaturated fiberglass adhesive, phenolic adhesive, epoxy adhesive, and silicone adhesive. In some embodiments, the adhesive is an elastomeric or silicone base adhesive.

In some embodiments, a process for producing a fiber enforced thin brick sheet comprises thin brick grout. In some embodiments, the thin brick grout is cement based. In some embodiments, the thin brick grout is sand based.

In some embodiments, a process for producing a fiber enforced thin brick sheet comprises substantially non-stretchable fiber enforced thin brick sheet having holes ranging from 1/16 inch to 2 inches for adhesive bonding.

In some embodiments, a process for producing a fiber enforced thin brick sheet comprises a fiber enforced mesh sheet ranging from 2.5 oz to 30 oz and is designed to hold the weight of multiple thin bricks.

In some embodiments, a process of applying thin bricks comprises accelerating the curing of the adhesive by the application of heat. In some embodiments, the adhesive is of high heat thus accelerating the curing time.

In some embodiments, a continuous process for producing a fiber enforced thin brick sheet on an endless belt, where thin bricks are applied using an adhesive, comprises: (a) feeding a reinforcing fabric onto the endless belt; (b) passing the reinforcing fabric on the endless belt through an impregnating zone wherein the fabric is saturated with a high heat adhesive; (c) passing the adhesive-saturated fabric through a thin brick application zone wherein the array of thin bricks are applied to the adhesive-saturated fabric; (d) passing the adhesive-impregnated fabric with thin bricks through an oven which raises the temperature of the adhesive to increase its curing rate and to bond the thin bricks to the backing layer comprising of fabric reinforced glue adhesive; (e) moving the fiber enforced thin brick sheet to a cutting zone wherein the sheet is cut into sections of desired size. Optional grouting steps include: (f) moving the substantially cured backing layer with bonded thin bricks through a grouting zone wherein material is deposited in the spaces between the edges of adjacent thin bricks on the sheet; (g) moving the substantially cured backing layer with bonded thin bricks through a cleaning zone wherein water, air, or cleaning solution is applied.

In some embodiments, a fiber enforced sheet of thin bricks for use as a wall surface or the like comprises: a flexible, substantially non-stretchable, backing sheet; a plurality of thin bricks bonded on their back surfaces to said backing sheet in a side-by-side, laterally spaced array; and a filler grout between said thin bricks. In some embodiments, the fiber enforced backing is adhered to the brick using an adhesive.

In some embodiments, the fiber enforced sheet of thin bricks for use as a wall surface or the like further comprises a contact adhesive between the backing sheet and the back surfaces of the thin bricks.

In some embodiments, the backing sheet is a fabric impregnated with a synthetic adhesive.

In some embodiments, the thin bricks are rectangular, and the sheet array is rectangular also.

In some embodiments, a process for making an anti-adhesive paper enforced sheet comprises: non bonding the back surfaces of a plurality of thin bricks to a substantially non-stretchable backing sheet covering the back surfaces of said thin bricks with a flexible sheet used for releasing of adhesive from said sheets.

In some embodiments, a fiber enforced sheet of thin bricks for use as a wall surface or the like comprises: a flexible, substantially non-stretchable backing sheet; a plurality of thin brick corners bonded on their back surfaces to said backing sheet in a stacked vertically spaced array; and a filler grout between said thin bricks.

In some embodiments, a corner brick is bonded to the fiber enforced backing. In some embodiments, the fabric is bent at an angle to that of the matching brick.

In some embodiments, a process of manufacturing fiber sheets bonded to corner brick comprises using adhesive bonders.

In some embodiments, the corner thin brick is adhered in such a way as to give ¼ inch to ¾ inch exact spacing between corner bricks.

In some embodiments, a process for producing a fiber enforced thin brick sheet on an assembly process of hand gluing individual thin bricks to a fiber sheet comprises using a grid, template or stencil.

In some embodiments, a process for producing a fiber enforced corner thin brick sheet on an assembly process of hand gluing individual thin bricks to a fiber sheet comprises using a grid, template or stencil.

In some embodiments, a process of adhering thin brick to fiber enforced sheets comprises using an adhesive that has high elevated temperatures thus curing quickly so as to facilitate manufacture of the thin brick sheets in a timely way.

In some embodiments, a process of adhering fiber enforced sheets to a floor or a wall comprises using an adhesive that penetrates thru said fiber enforced sheets providing a grid like bonding pattern for grout or mortar.

In some embodiments, a process of adhering fiber enforced sheets to a floor or a wall comprises using an adhesive that penetrates thru said fiber enforced sheets and adheres to a majority of the exposed thin brick thus helping bond the brick to the floor or the wall.

In some embodiments, a process of adhering fiber enforced sheets to a floor or a wall comprises applying an adhesive to a wall or a floor followed by applying a fiber enforced sheet thus enabling the adhesive to penetrate thru the fiber enforced sheet to help hold or cling to wall or floor surfaces.

SUMMARY

Alternatively, the sheets of the present invention may be manufactured individually in multiple sizes. Thin bricks are placed face down or face up within the confines of a frame designed to hold the loose thin bricks in a rectangular array. Gaps are left between the edges of adjacent thin bricks to permit the subsequent insertion of grout as is well known in the art.

Reinforcing fabric for the backing layer is then placed over the exposed rear surfaces of the thin brick elements in the array. A adhesive is then applied to the fabric first or brick first, saturating it and extending through it to contact the thin bricks or sheets. As the adhesive cures it bonds the backing layer to the thin bricks. This process may be accelerated by the application of heat to raise the temperature of the adhesive/catalyst mixture thereby increasing its cure rate.

When the adhesive of the backing layer has substantially cured, the backing layer with the thin brick elements bonded to it is inverted, exposing the front face of the thin brick elements. Grout or mortar other suitable or alike material is applied to the spaces between the thin bricks.

In use, the thin brick sheets are mounted to conventional floor or wall surfaces using construction adhesives of the type previously mentioned.

While one specific embodiment of the invention has been disclosed herein, it should be understood that this disclosure is made by way of illustration rather than limitation. Numerous changes may be made by those skilled in the art, particularly with reference to the dimensions, materials and configuration disclosed herein. Changes of this nature would not depart from the spirit of the invention or the scope of the appended claims.

What is claimed:

1. A thin brick system, comprising:

a first prefabricated fiber enforced thin brick sheet comprising:

a first fiber-reinforced backing layer that defines an elongated corner, wherein the first fiber-reinforced backing layer comprises a first portion that extends away from the corner in a first direction and defines a first edge spaced from the corner, and wherein the first fiber-reinforced backing layer comprises a second portion that extends away from the corner in a second direction that is different from the first direction and defines a second edge that is spaced from the corner, wherein the first fiber-reinforced backing layer comprises fiberglass fibers and one or more holes;

a first plurality of thin bricks that are bonded to the first fiber-reinforced backing layer via an adhesive, wherein each thin brick of the first plurality of thin bricks:

defines a corner that covers a portion of the corner of the first fiber-reinforced backing layer;

comprises a first portion that extends in the first direction and is bonded to the first portion of the first fiber-reinforced backing layer; and comprises a second portion that extends in the second direction and is bonded to the second portion of the first fiber-reinforced backing layer; and an anti-adhesive paper that defines a corner that corresponds with the corner of the first fiber-reinforced backing layer, wherein the first portions of the thin bricks of the first plurality are staggered and the second portions of the thin bricks of the first plurality are staggered such that some of the first portions are recessed from the first edge of the first fiber-reinforced backing layer and some of the second portions are recessed from the second edge of the first fiber-reinforced backing layer, and wherein the first plurality of thin bricks are bonded via the adhesive to each of the first fiber-reinforced backing layer and the anti-adhesive paper as a first unitary prefabricated thin brick sheet that is configured to be mounted to a floor or wall surface after release of the anti-adhesive paper from the adhesive, each thin brick of the first plurality being bonded to the first fiber-reinforced backing layer such that a portion of the rear surface of the thin brick is free from the adhesive, wherein the portion of the rear surface of the thin brick that is free from the adhesive overlaps one or more holes in the first fiber-reinforced backing layer such that a construction adhesive can penetrate through the first fiber-reinforced backing layer to adhere to the portion of the rear surface of the thin brick that is free from the adhesive to bond the thin brick to a wall or floor surface; and a second prefabricated fiber enforced thin brick sheet comprising:

a second fiber-reinforced backing layer; and a second plurality of thin bricks that are bonded to the second fiber-reinforced backing layer such that some of the thin bricks of the second plurality overhang the second fiber-reinforced backing at a first edge of the second fiber-reinforced sheet so as to be configured to couple the second prefabricated fiber enforced thin brick sheet to the first prefabricated fiber enforced thin brick sheet.

2. The thin brick system of claim 1, wherein the first portion of the first fiber-reinforced backing layer comprises regions that extend beyond some of the first portions of the thin bricks of the first plurality, and wherein the regions of the first portion of the first fiber-reinforced backing layer are configured to be coupled with portions of thin bricks of the second plurality that overhang the second fiber-reinforced backing.

3. The thin brick system of claim 1, wherein the adhesive is selected from the group consisting of unsaturated fiberglass adhesive, phenolic adhesive, bonding adhesive, epoxy adhesive, and silicone adhesive.

4. The thin brick system of claim 1, wherein the adhesive is substantially non-stretchable and is substantially impervious to moisture.

5. The thin brick system of claim 1, wherein the first fiber-reinforced backing layer is flexible and substantially non-stretchable.

6. The thin brick system of claim 1, wherein the first fiber-reinforced backing layer comprises holes sized from between 1/16 inch to 2 inches, and wherein the holes are configured to permit adhesive to extend through the holes to bond the first plurality of thin bricks to the first fiber-reinforced backing layer.

7. The thin brick system of claim 1, wherein the fiberglass fibers are woven into a grid-like sheet.

8. The thin brick system of claim 1, wherein each of the first plurality of thin bricks are spaced from one another to provide spaces between adjacent bricks that are configured to be filled with mortar or grout.

9. The thin brick system of claim 8, wherein a distance defined by the spaces between adjacent bricks is within a range of from approximately ¼ inch to ¾ inch.

10. The thin brick system of claim 1, wherein the thin bricks of the first plurality are stacked vertically in a spaced array.

11. The thin brick system of claim 1, wherein the second fiber-reinforced backing layer comprises regions that extend beyond the second plurality of thin bricks at a second edge of the second fiber-reinforced sheet, and wherein the first and second edges of the second fiber-reinforced backing are at opposite ends of the second fiber-reinforced backing.

12. The thin brick system of claim 1, wherein the second prefabricated fiber enforced thin brick sheet is rectangular.

13. A prefabricated fiber enforced thin brick sheet comprising:

a fiber-reinforced backing layer that defines an elongated corner, wherein the fiber-reinforced backing layer comprises a first portion that extends away from the corner in a first direction and defines a first edge spaced from the corner, and wherein the fiber-reinforced backing layer comprises a second portion that extends away from the corner in a second direction that is different from the first direction and defines a second edge that is spaced from the corner, wherein the fiber-reinforced backing layer comprises fiberglass fibers and one or more holes; and a plurality of thin bricks that are bonded to the fiber-reinforced backing layer via an adhesive, wherein each thin brick:

defines a corner that covers a portion of the corner of the fiber-reinforced backing layer;

comprises a first portion that extends in the first direction and is bonded to the first portion of the fiber-reinforced backing layer; and comprises a second portion that extends in the second direction and is bonded to the second portion of the fiber-reinforced backing layer;

wherein some of the first portions of the bricks are recessed from the first edge of the fiber-reinforced backing layer and some of the second portions of the bricks are recessed from the second edge of the fiber-reinforced backing layer, wherein regions of the first portion of the fiber-reinforced backing layer extend beyond the first portions of the thin bricks that are recessed from the first edge of the fiber-reinforced backing layer, wherein regions of the second portion of the fiber-reinforced backing layer extend beyond the second portions of the thin bricks that are recessed from the second edge of the fiber-reinforced backing layer, and wherein the regions of the first and second portions of the fiber-reinforced backing layer are configured to be coupled with portions of additional thin bricks, wherein first bricks that have first portions that are recessed from the first edge of the fiber-reinforced backing layer also have second portions that extend to the second edge of the fiber-reinforced backing layer, and wherein second bricks that have second portions that are recessed from the second edge of the fiber-reinforced backing layer have first portions that extend to the first edge of the fiber-reinforced backing layer, and wherein the plurality of thin bricks are bonded via the adhesive to the fiber-reinforced backing layer as a unitary prefabricated thin brick sheet that is configured to be mounted to a floor or wall surface, each thin brick being bonded to the fiber-reinforced backing layer such that a portion of the rear surface of the thin brick is free from the adhesive, wherein the portion of the rear surface of the thin brick that is free from the adhesive overlaps one or more holes in the fiber-reinforced backing layer such that a construction adhesive can penetrate through the fiber-reinforced backing layer to adhere to the portion of the rear surface of the thin brick that is free from the adhesive to bond the thin brick to a wall or floor surface.

14. The sheet of claim 13, wherein the additional thin bricks with which the regions of the first portion of the fiber-reinforced backing layer are configured to be coupled are bonded to an additional fiber-reinforced backing layer, and wherein the additional thin bricks overhang an edge of the additional fiber-reinforced backing layer.

15. A thin brick sheet system that comprises:

the sheet of claim 13; and an additional sheet that comprises:

a fiber-reinforced backing layer; and a plurality of thin bricks that are bonded to the fiber-reinforced backing layer such that some of the thin bricks overhang the fiber-reinforced backing at a first edge of the fiber-reinforced sheet so as to be configured to interlock with the first portions of the thin bricks of the sheet of claim 13.

16. The thin brick sheet system of claim 15, wherein the fiber-reinforced backing layer of the additional sheet comprises regions that extend beyond the thin brick elements at a second edge of the fiber-reinforced sheet, and wherein the first and second edges of the fiber-reinforced backing of the additional sheet are at opposite ends of the fiber-reinforced backing.

17. The thin brick sheet system of claim 15, wherein the plurality of thin bricks and the fiber-reinforced backing layer of the additional sheet are rectangular.

* * * * *